US008246385B2

(12) United States Patent
Hsu et al.

(10) Patent No.: US 8,246,385 B2
(45) Date of Patent: Aug. 21, 2012

(54) ELECTRICAL CONNECTOR ASSEMBLY

(75) Inventors: Ya-Hui Hsu, Taipei (TW); Mei-Chuan Yang, Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 112 days.

(21) Appl. No.: 12/948,760

(22) Filed: Nov. 18, 2010

(65) Prior Publication Data

US 2012/0129406 A1 May 24, 2012

(51) Int. Cl.
*H01R 24/00* (2011.01)

(52) U.S. Cl. ..... 439/626

(58) Field of Classification Search ..... 439/626, 439/884, 381, 816, 78, 66; D13/147
See application file for complete search history.

(56) References Cited

U.S. PATENT DOCUMENTS

| | | | | |
|---|---|---|---|---|
| 8,002,584 | B1 * | 8/2011 | Hsu et al. | 439/626 |
| D648,276 | S * | 11/2011 | Hsu et al. | D13/147 |
| D648,277 | S * | 11/2011 | Hsu et al. | D13/147 |
| 2011/0256771 | A1 * | 10/2011 | Jin | 439/626 |
| 2011/0318966 | A1 * | 12/2011 | Huo et al. | 439/626 |

* cited by examiner

*Primary Examiner* — Hae Moon Hyeon
(74) *Attorney, Agent, or Firm* — Lin & Associates IP, Inc.

(57) ABSTRACT

A connector has a top housing, a bottom housing coupled with the top housing, a plurality of terminals mounted in the top housing. The terminal has a base slice. The base slice is bent perpendicularly to form a first holding slice which has lateral sides extended outward to form a pair of fixing slices. The top housing is recessed to form a plurality of receiving passages. The receiving passage has a bottom thereof recessed to form a pair of fixing recesses. The terminal is received in the receiving passage. The fixing slices are received in the fixing recesses, which prevents the soldering slice to be knocked while assembling the bottom housing to the top housing.

5 Claims, 6 Drawing Sheets

ELECTRICAL CONNECTOR ASSEMBLY

BACKGROUND OF THE INVENTION

1. Field of the Invention

The present invention relates to an electrical connector, and more particularly to a connector that is convenient to assembly.

2. The Related Art

A conventional connector has a top housing, a bottom housing coupled with the top housing, a plurality of terminals mounted into the top housing. The top housing has a plurality of receiving passages therethrough. The terminals mounted into the receiving passages has a base slice, a first holding slice and a second holding slice respectively extended from two opposite ends of the base slice. A free end of the second holding slice is extended downward to form a soldering slice. However, as the first holding slice and the second holding slice are not fixed well, the soldering slice may be knocked by the bottom housing to be out of shape, which affects the quality of the product and brings difficulty to the assembly of the bottom housing.

SUMMARY OF THE INVENTION

Accordingly, an object of the present invention is to provide a connector. The connector has a top housing, a bottom housing coupled with the top housing, a plurality of terminals mounted in the top housing. The top housing is recessed to form a plurality of receiving passages therethrough. A bottom of the lateral sides of, the receiving passage is recessed outward to from at least one pair of fixing recesses. The bottom housing coupled with the top housing has a top thereof protruded to form a plurality of supporting portions received in the corresponding receiving passages. The supporting portion is recessed to form a passageway through the bottom housing. The terminal has a base slice, a contacting portion exposed from a top of the top housing. A bottom of the base slice is extended perpendicularly to form a first holding slice located at a bottom of the receiving passage. The first holding slice has lateral sides protruded outward to form at least one pair of fixing slices located in the fixing recesses. A free end of the first holding slice is extended downward to form a soldering slice received in the passageway and stretching out of the bottom housing.

As described above, the fixing slice is received in the fixing recess for fixing the first holding slice in the receiving passage, which prevents the soldering slice to be knocked while assembling the bottom housing.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
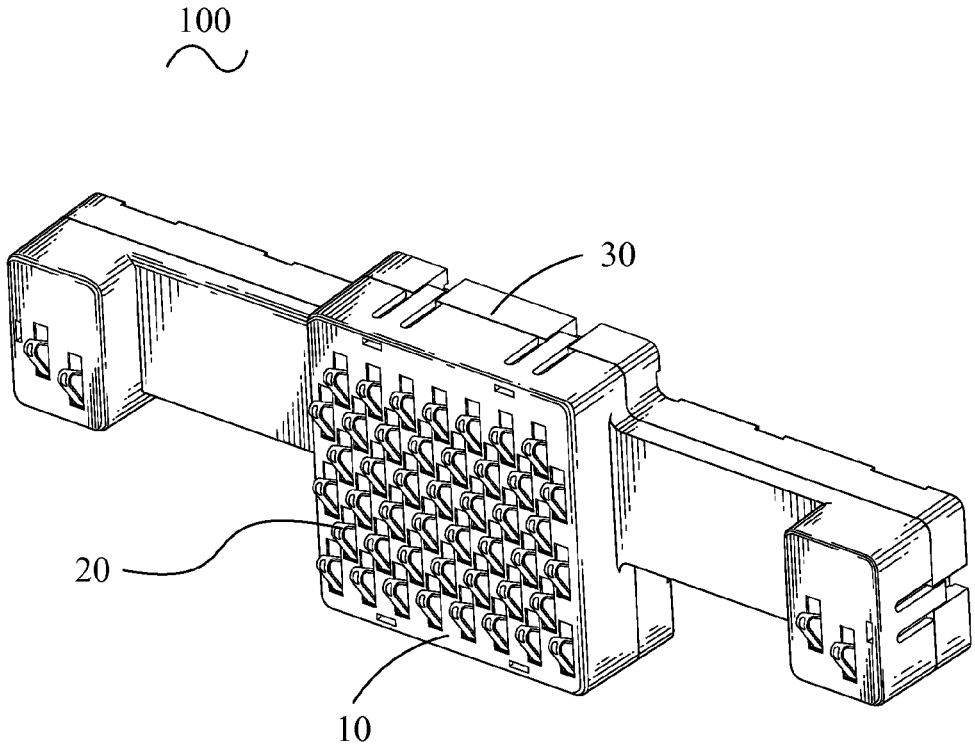
FIG. 1 is an assembled, perspective view of a connector of an embodiment in accordance with the present invention.
Figure 2:
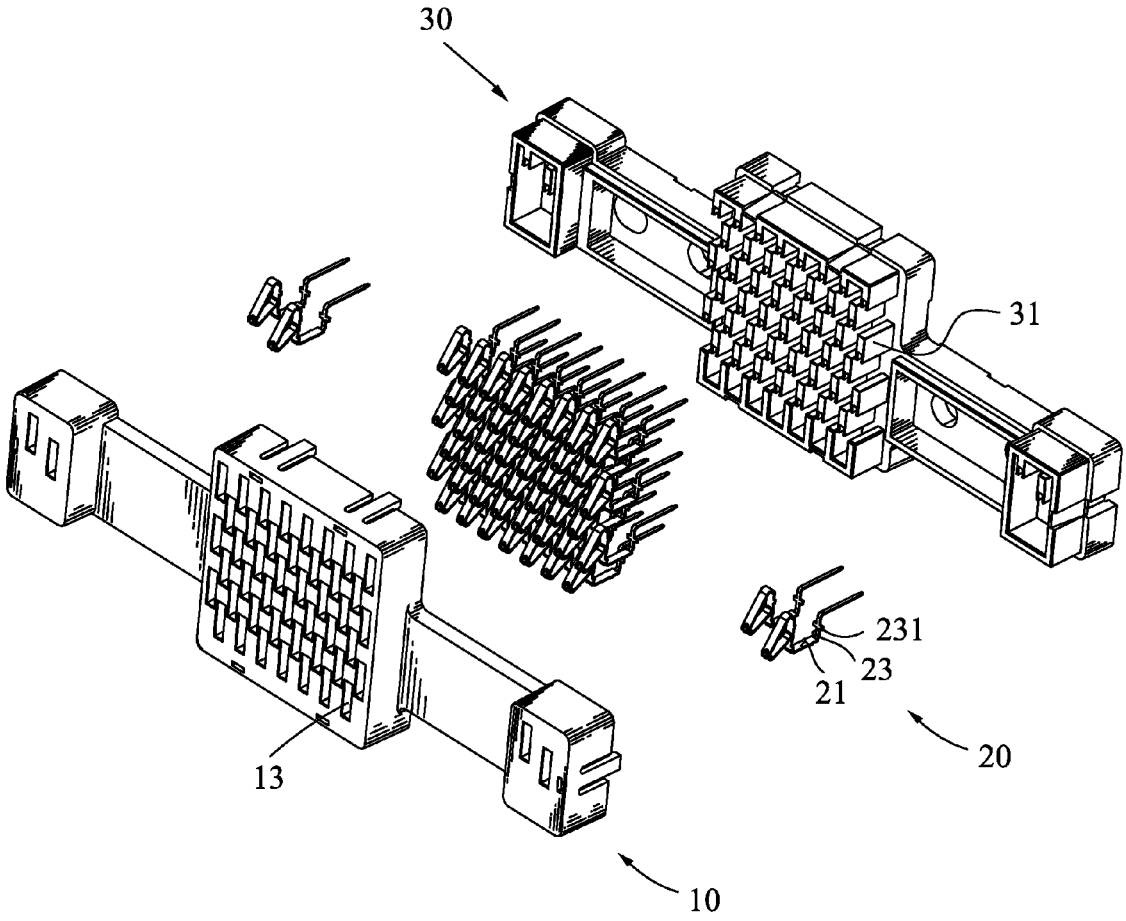
FIG. 2 is an exploded, perspective view of the connector shown in FIG. 1.

Referring to the drawings in greater detail, and first to FIGS. 1-2, the embodiment of the invention is embodied in a connector 100. The connector 100 has a top housing 10, a bottom housing 30 coupled with the top housing 10, a plurality of terminals 20 mounted in the top housing 10.

With reference to FIGS. 2-5, the terminals 20 fixed on the top housing 10 has a base slice 21 which has barbs 211 formed at a substantially middle portion thereof. A bottom and a top of the base slice 21 are extended toward the same direction to form a first holding slice 23 and a second holding slice 22, respectively. A free end of the second holding slice 22 is connected with an elastic arm 24 of substantially inverted-V shape with an opening facing to the second holding slice 22. The elastic arm 24 has an apex formed with a contacting portion 25. The second holding slice 22 has lateral sides thereof extended outward to form two pairs of buckling slices 221. The first holding slice 23 has lateral sides extended outward to form a pair of fixing slices 231. A free end of the first holding slice 23 is extended downward to form a soldering slice 26 of strip shape.

Figure 3:
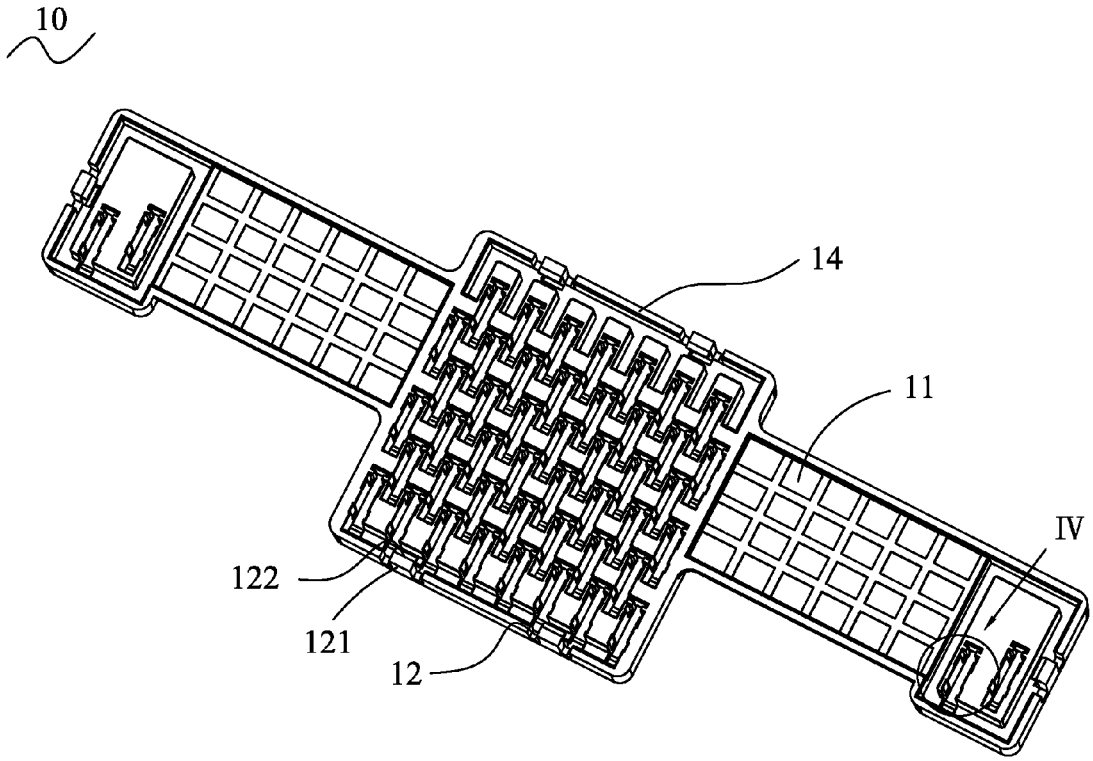
FIG. 3 is a perspective view of a top housing of the connector shown in FIG. 2.
Figure 4:
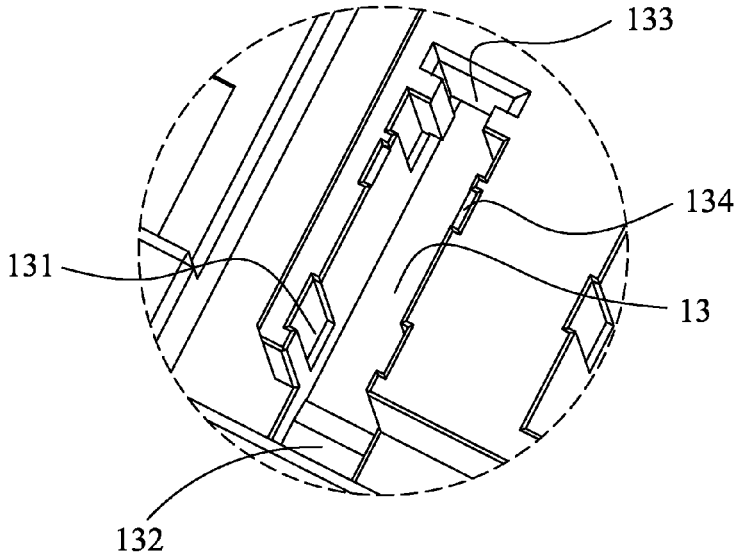
FIG. 4 is a partly enlarged view showing an enlarged IV portion of FIG. 3.
Figure 5:
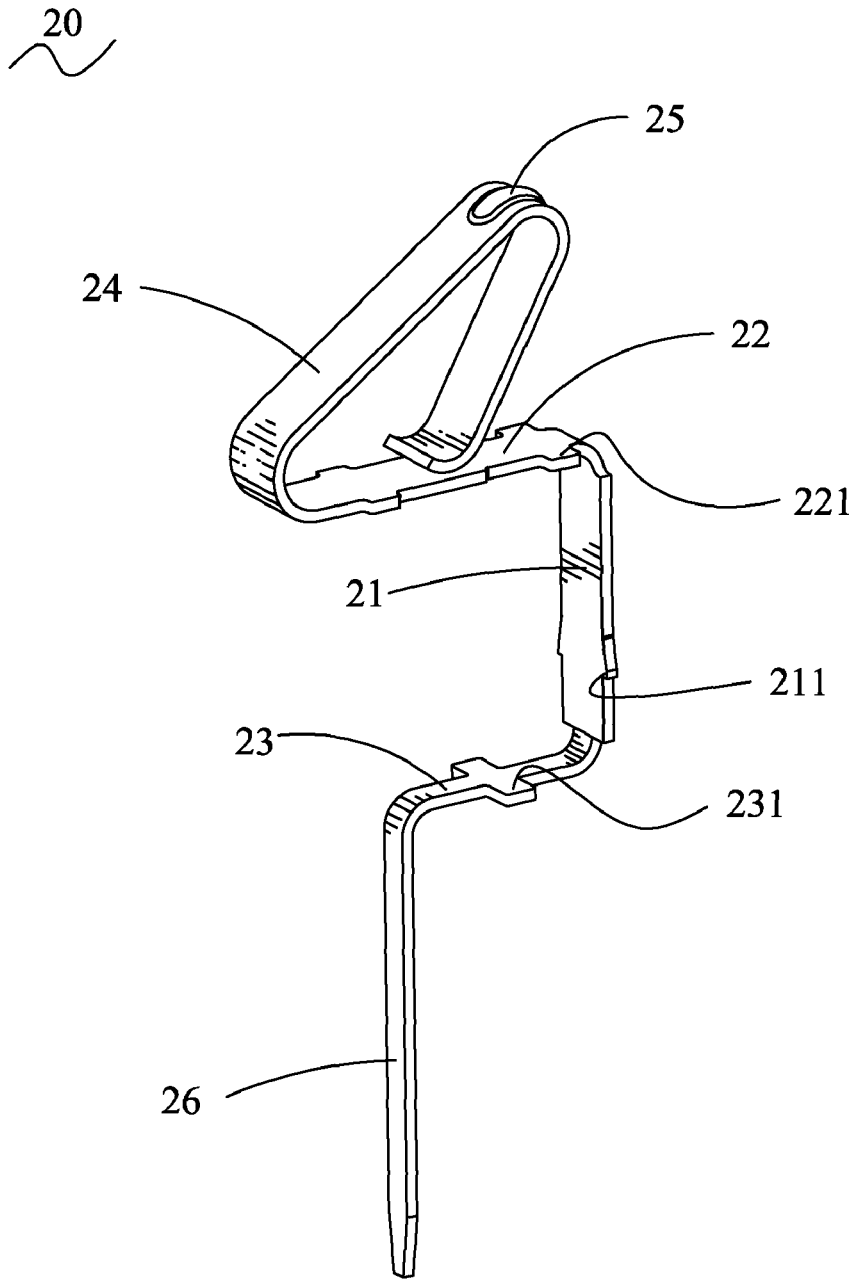
FIG. 5 is a perspective view of a terminal shown in FIG. 2.

Referring to FIGS. 3-4, a bottom of the top housing 10 is recessed to form a receiving space 11 surrounded by a frame 14. The frame 14 is formed with a plurality of gaps 12. A middle portion of each gap 12 is protruded to form a fixing rail 121 extending beyond the frame 14. A free end of the fixing rail 121 is formed with a wedge 122. In this embodiment, a front and a rear side of the frame 14 is formed with a pair of fixing rails 121 respectively. Two opposite ends of the frame 14 is formed with a fixing rail 121 respectively.

A middle portion of the top housing 10 is formed with a plurality of receiving passages 13 through a top and a bottom of the top housing 10 and communicating with the receiving space 11. One end of the receiving passage 13 is enlarged outwardly to form a positioning groove 133. Two lateral sides of the receiving passage 13 are recessed outwardly to form two pair of vertical slots 131 with a closed top end and an open bottom end. A pair of fixing recesses 134 is formed by bottoms of the two lateral sides of the receiving passage 13 being recessed outwardly and between the vertical slots 131. The other end of the receiving passage 13 has a top portion protruded inward to form a resting portion 132.

Figure 6:
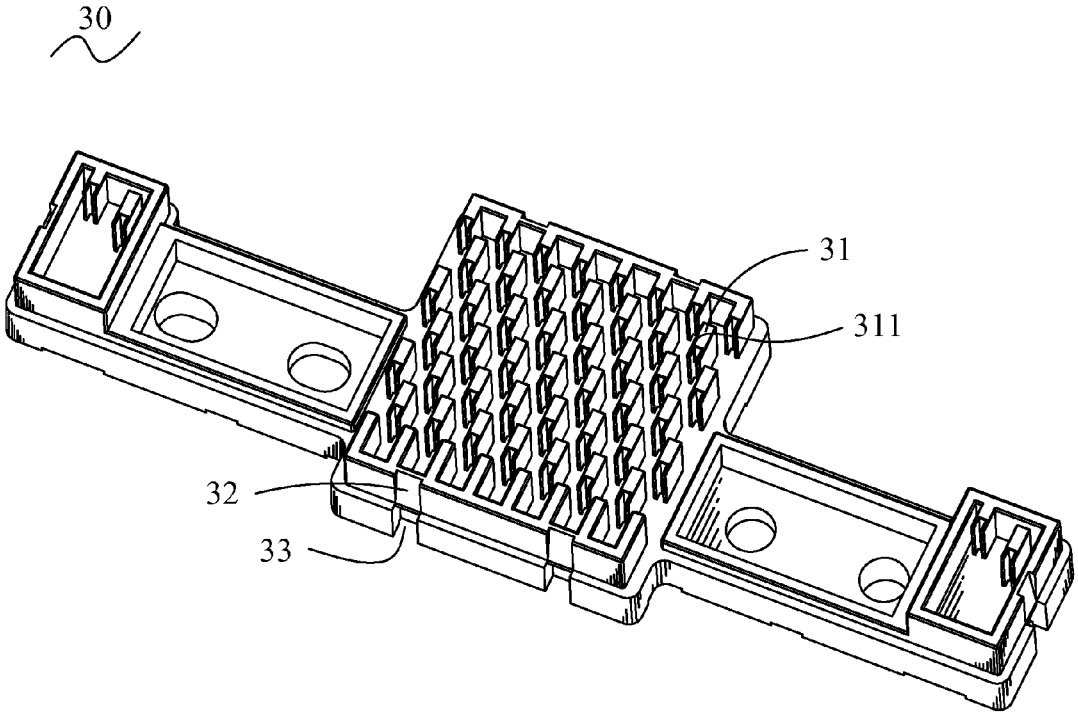
FIG. 6 is a perspective view of a bottom housing of the connector shown in FIG. 2.
Figure 7:
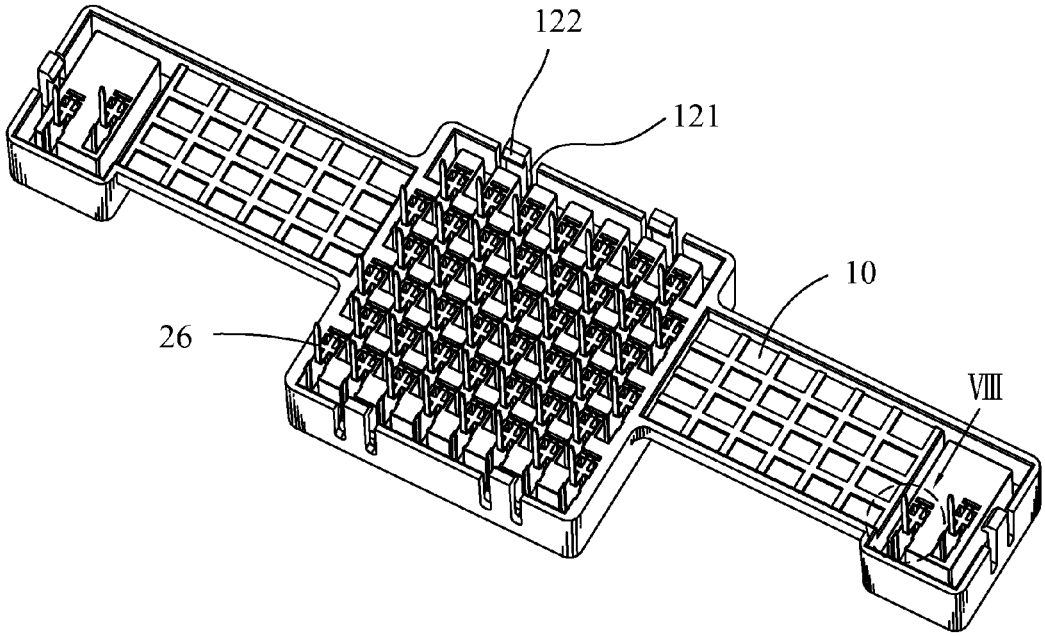
FIG. 7 is a perspective view of the top housing having a plurality of terminals mounted therein.
Figure 8:
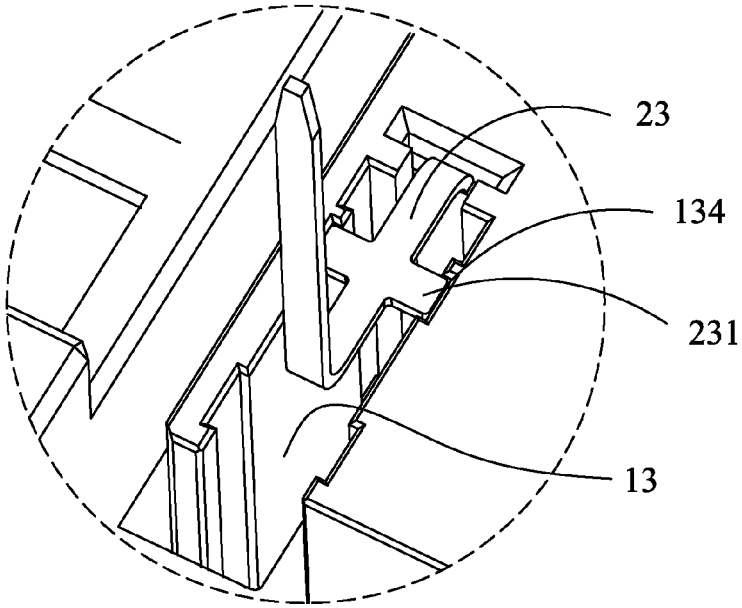
FIG. 8 is a partly enlarged view showing an enlarged VIII portion of FIG. 7.

Please refer to FIGS. 6-7, the bottom housing 30 assembled to the bottom of the top housing 10 has a middle portion protruded to form a plurality of supporting portions 31 corresponding to the receiving passages 13. A lateral side of the supporting portion 31 is recessed to form a passageway 311 through the bottom housing 30. Corresponding to each fixing rail 121, a guiding recess 32 is formed at the periphery of the bottom housing 30 for guiding the fixing rail 121 while assembling the bottom housing 30. A bottom of the guiding recess 32 is further recessed to form a buckling recess 33 buckling with the wedge 122 for fixing the top housing 10 on the bottom housing 30 firmly.

With reference to the FIGS. 3-8, the terminals 20 are assembled into the top housing 10 from a bottom side. The base slice 21 is inserted into the positioning groove 133 with the barbs 211 interfering with lateral sides of the positioning groove 133 so as to fix the base slice 21 firmly in the positioning groove 133. The second holding slice 22 is located at an upper portion of the receiving passage 13 with the buckling slices 221 received at the top end of the vertical slot 131, meanwhile, the first holding slice 23 is located at a bottom of the receiving passage 13 with the fixing slice 231 received at the fixing recess 134. The elastic arm 24 has a lower part adjacent to a joint between the elastic arm 24 and the second holding slice 22 resting against the resting portion 132 and a top part stretching out of the top of the top housing 10.

While assembling the bottom housing 30 to the top housing 10, the supporting portion 31 is received in the corresponding receiving passage 13 and supports the second holding slice 22. The first holding slice 23 has a part, adjacent to the soldering slice 26, fixed in the passageway 311. The soldering slice 26 is inserted into the passageway 311 and stretches out of the bottom housing 30.

As described above, the buckling slice 221 is received in the vertical slot 131 for fixing the second holding portion 22 in the top housing 10. The elastic arm 24 rests against the resting portion 132 for preventing the deformation of the terminals 20 caused by the pulling of the contacting portion 25 by an external force. The fixing slice 231 is received in the fixing recess 134 for fixing the first holding slice 23, which prevents the soldering slice 26 to be knocked while assembling the bottom housing 30 to the top housing 10.

What is claimed is:

1. A connector, comprising:

a top housing recessed to form a plurality of receiving passages therethrough, the bottoms of the lateral sides of the receiving passage recessed outward to from at least one pair of fixing recesses;

a bottom housing coupled with the top housing having a top thereof protruded to form a plurality of supporting portions received in the corresponding receiving passages, the supporting portion recessed to form a passageway through the bottom housing; and a plurality of terminals mounted in the receiving passages each having a base slice, a contacting portion exposed from a top of the top housing, a bottom of the base slice extended perpendicularly to form a first holding slice located at a bottom of the receiving passage, the first holding slice having lateral sides protruded outward to form at least one pair of fixing slices located in the fixing recesses, a free end of the first holding slice extended downward to form a soldering slice received in the passageway and stretching out of the bottom housing.

2. The connector as claimed in claim 1, wherein a top of the base slice is extended toward the same direction as the first holding slice to form a second holding slice.

3. The connector as claimed in claim 2, wherein a free end of the second holding slice is connected with an elastic arm of substantially inverted-V shape with an opening facing to the second holding slice, the elastic arm has an apex formed with the contact portion.

4. The connector as claimed in claim 3, wherein one end of the receiving passage is enlarged outward to form a positioning groove for receiving the base slice, the other end of the receiving passage has a top portion protruded inward to form a resting portion for resting against the elastic arm, which prevents the deformation of the terminal.

5. The connector as claimed in claim 4, wherein the lateral sides of the base slice are formed with barbs interfering with the positioning groove for fixing the base slice in the positioning groove.

* * * * *